United States Patent [19]

Knudsen

[11] Patent Number: 4,775,300

[45] Date of Patent: Oct. 4, 1988

[54] HEATING OIL PUMP FOR SELECTIVE SINGLE OR DOUBLE LINE OPERATION

[75] Inventor: Hans J. Knudsen, Sønderborg, Denmark

[73] Assignee: Danfoss A/S, Nordborg, Denmark

[21] Appl. No.: 28,559

[22] Filed: Mar. 20, 1987

[51] Int. Cl.[4] ..... F04B 49/02

[52] U.S. Cl. ..... 417/304; 417/305; 417/310

[58] Field of Search ..... 417/303, 305, 310, 440, 417/442, 502

[56] References Cited

U.S. PATENT DOCUMENTS

| | | | |
|---|---|---|---|
| 1,628,905 | 7/1928 | Goldberg | 251/263 |
| 2,144,228 | 1/1939 | Penick et al. | 251/263 |
| 2,654,323 | 10/1953 | Wahlmark | 417/303 |
| 2,915,015 | 12/1959 | Erikson | 417/303 |
| 3,531,220 | 9/1970 | Enemark | 417/310 |
| 3,580,420 | 5/1971 | Kennedy | 417/442 |
| 3,612,722 | 10/1971 | Neward | 417/305 |
| 3,685,925 | 8/1972 | McJones | 417/302 |
| 3,865,518 | 2/1975 | Sjofun | 417/440 |

*Primary Examiner*—William L. Freeh

*Attorney, Agent, or Firm*—Wayne B. Easton; Clayton R. Johnson

[57] ABSTRACT

A heating oil pump which is intended for selective single or double line operation. Between the suction side and return side there is a connecting passage which, for double line operation, is closable by a closure member. The latter is displaceable upon insertion of a plug from a closed to an open position by an actuating element which projects into the inserting path of the plug and, upon removal of the plug, back to the closed position by a return spring. This results in automatic change-over without the need for the return pressure to be higher than the suction pressure.

5 Claims, 2 Drawing Sheets

HEATING OIL PUMP FOR SELECTIVE SINGLE OR DOUBLE LINE OPERATION

The invention relates to a heating oil pump for selective single or double line operation, comprising a suction nipple, a return nipple closable by a plug for single line operation and a nozzle-connecting nipple as well as a connecting passage which is disposed between the suction and return sides and is closable by a closure member for double line operation.

Such a heating oil pump is known from the Danfoss Prospectus BK.10.C3.02 "Oil Pumps Type MSL" dated November 1980, pages 2 and 3. For single line operation, the return nipple is closed by a plug and for double line operation the connecting passage is closed by a plug. This creates the danger of the mechanic inserting the wrong plug before he connects the heating oil pump for single or double line operation. The mistake will be discovered only when the installation is working. The pump will then either not be able to suck in the oil or an excessive pressure will be built up in it that could, under unfavourable circumstances, burst the stuffing box.

It is therefore already known (DE-PS No. 20 08 510) to replace the plugs with a cover which can assume two positions recognisable from the outside. In the one position, the return nipple is closed and in the other position the connecting passage is closed. However, such a cover requires additional passages and is expensive.

Automatic change-over has also already been provided (DE-OS No. 15 51 651) insofar that the connecting passage contains a springloaded check valve which is open towards the suction side. When the plug has been inserted in the return nipple, the check valve opens because a pressure is built up on the return side. However, it remains closed when the plug has been removed for double line operation. The disadvantage in this case is that, for single line operation, the return pressure is higher than for double line operation because the spring force of the check valve has to be overcome. Since the return pressure has a certain influence on the nozzle pressure, this means that an optimum nozzle pressure suitable for single line as well as double line operation cannot be set in the first place. The higher return pressure during double line operation also requires more power for the pump. At the same time, the increased return pressure means that there is a higher pressure in the stuffing box normally connected to the return side. The height of an upwardly disposed tank is therefore limited because one will otherwise exceed the maximum permissible pressure in the stuffing box.

The previously mentioned heating oil pump has a safety valve which precedes the nozzle-connecting nipple. In the safety valve, a drainage covers an outlet passage and an annular passage which surrounds the outlet passage and is connected to the pressure side of the pump and on the opposite side the diaphragm is biased by a spring in a chamber having an oil outlet orifice. Oil trickling past the diaphragm is led away through the oil outlet orifice. The latter is connected to the return side of the pump. When the return pressure changes, as may happen during the previously described automatic change-over or when altering the height of the tank, the opening or closing pressure of the safety valve will also change.

The invention is based on the problem of providing a heating oil pump of the aforementioned kind in which the return pressure or its influence on the nozzle behaviour will not change during alterations, particularly during automatic change-over.

This problem is solved in a first embodiment in that the closure member is displaceable upon insertion of the plug from a closed to an open position by an actuating element which projects into the inserting path of the plug and, upon removal of the plug, back to the closed position by a return spring.

In this construction, it is merely necessary to insert the plug in the return nipple or to remove it. The closure member in the connecting passage will then automatically assume the associated closed or open position. Since no spring force has to be overcome in the open position, the return pressure for single line operation is not higher than for double line operation. The energy consumption of the pump is correspondingly lower during double line operation. The tank can be disposed at a higher elevation without bursting the stuffing box.

It is advisable for the closure member to be axially displaceable and to co-operate in its closed position with a valve seat. Axial displacement is particularly simple to bring about.

In particular, adjoining an outer screwthread, the plug may have a tappet of smaller diameter. This tappet may co-operate with the actuating element.

In particular, the inner end of the plug should have a cone which converges in the inserting direction. This allows the actuating element to be particularly easily displaced.

The actuating element itself may have an oblique surface facing the plug. This serves to displace the actuating element substantially at right angles to the plug.

In particular, the oblique surface of the actuating element may be formed by a cone. The position in which the actuating element is built in will then be immaterial. Production is also simple.

A particularly favourable construction is obtained if the actuating element is formed by an extension of the closure member.

When using a cut-off valve between the pressure and return sides of the pump that is open in the rest position, it is advisable for a spring-loaded check valve opening towards the return side to be disposed in series with the cut-off valve. In this way, one prevents air from being circulated on starting the pump is the tank is disposed at the bottom and during single line operation.

In an alternative embodiment, which can be employed at the same time as the previously described embodiment, there is a safety valve which precedes the nozzle-connecting nipple, wherein a valve element, particularly a diaphragm, covers an outlet passage and an annular groove which surrounds the outlet passage and is connected to the pressure side of the pump and on the opposite side the diaphragm is loaded by a spring in a chamber provided with an oil outlet orifice. The characterising feature in this case is that the oil oulet orifice is connected to the suction side.

There is a constant pressure on the suction side. Changes in the return pressure have no influence on the closing and opening pressure of the safety valve. The safety valve therefore always responds to the set values irrespective of whether the return pressure changes for some reason, e.g. because of automatic change-over with the aid of a check valve.

It may in this case be favourable to provide a spring-loaded check valve which is disposed between the suction nipple at the suction side and opens towards the suction side. This check valve prevents the height of the tank from influencing the operation of the safety valve if the tank is at the top.

A preferred example of the invention will now be described in more detail with reference to the drawing, wherein.

Figure 1:
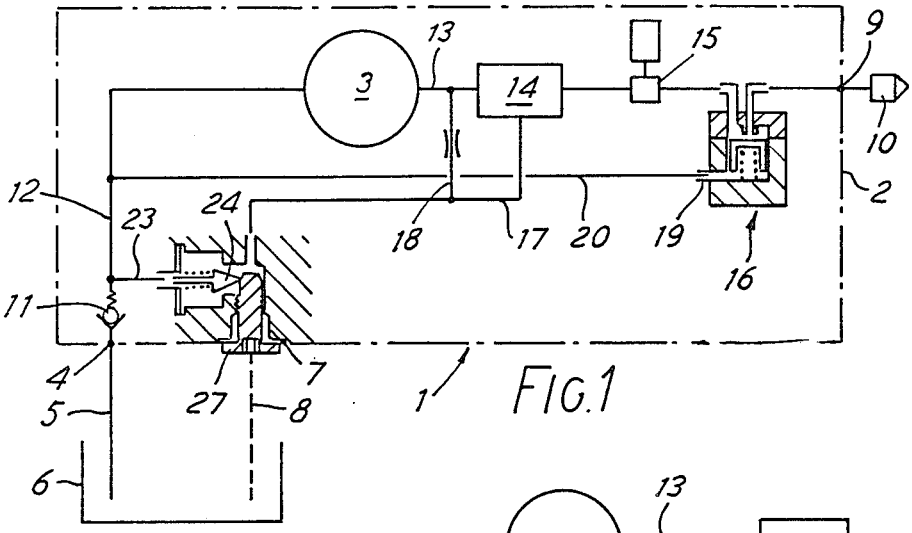
FIG. 1 is a diagrammatic representation of a heating oil pump according to the invention.

A heating oil pump 1 comprises a diagrammatically indicated housing 2 and a pump unit 3 therein, for example a gear pump. The housing has a suction nipple 4 connected by a suction line 5 to a heating oil tank 6, a return nipple 7 which can be connected to the tank 6 by way of a return conduit (line) 8, and a nozzle-connecting orifice 9 which can be connected to an atomizing nozzle 10. Other nipples for connecting manometers, ventilating apparatus etc. are not illustrated.

The suction nipple 4 is connected to the suction side 12 of the pump unit 3 (to the pump section part) by way of a spring-loaded check valve 11. The pressure side 13 of the pump unit 3 (pump pressure part) is connected to a pressure regulating valve 14 which, in turn, communicates with the nozzle-connecting nipple 9 by way of cut-off valve 15, for example a magnetic valve which is closed in the rest position, and by way of a safety valve 16. Excess oil is led to the return side 17 from the pressure regulating valve 14. Further, there is a throttle passage 18 between the pressure side 13 and the return side 17. An oil outlet orifice 19 of the safety valve 16 is connected by way of a conduit 20 to the suction side 12 of the pump unit 3.

Figure 2:
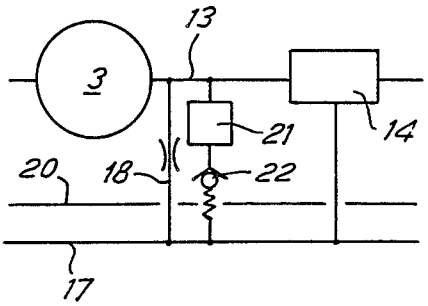
FIG. 2 is a fragmentary view of a modified embodiment.

As is illustrated in FIG. 2, instead of the normally closed cut-off valve 15 in series with the nozzle 10, one may also use a normally open cut-off valve 21 connected in series with a spring-loaded check valve 22 between the pressure side 13 and the return side 17. Such a cut-off valve is for example operated hydraulically by the pump pressure.

Figure 3:
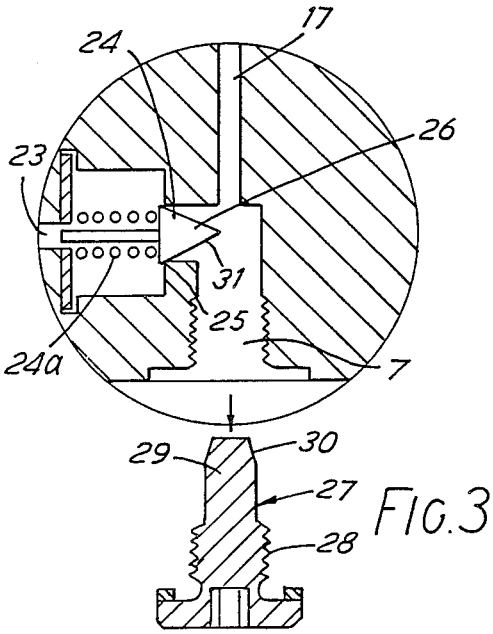
FIG. 3 is an enlarged view of the region of the return nipple with the plug removed.
Figure 4:
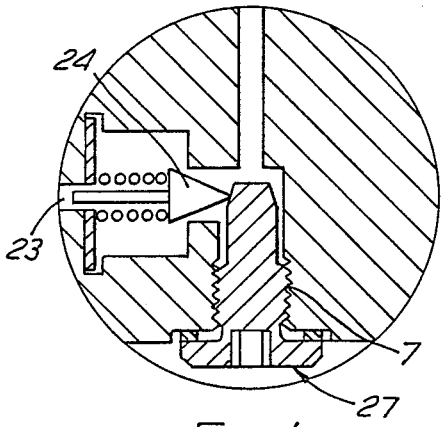
FIG. 4 shows the same region when the plug is inserted.

As evident by viewing FIGS. 1, 3 and 4 together, the return counduit 17 is connected by way of a connecting passage 23 to the suction side 12 in both embodiments. A closure member 24 in the connecting passage cooperates with a valve seat 25 and is loaded by a return spring 24a. The closure member 24 is provided with an extension which forms an actuating element 26 and which projects into the inserting path of a closure plug 27. Upon insertion of this plug 27, the closure member 24 is displaced out of the closing position into the opening position (FIG. 4). Upon removal of the plug 27, the closed position is resumed (FIG. 3) under the influence of the resetting spring 24a. For the purpose of better actuation, the plug has a tappet 29 of smaller diameter adjoining an external screwthread 28, the tappet terminating in a cone 30. The actuating element 26 is also formed by a cone 31. As may be seen from FIGS. 3 and 4, the valve seat 25 opens at right angles to the return nipple while the closure member 24 is movable at right angles to the direction of insertion of the closure plug into the return nipple.

Figure 5:
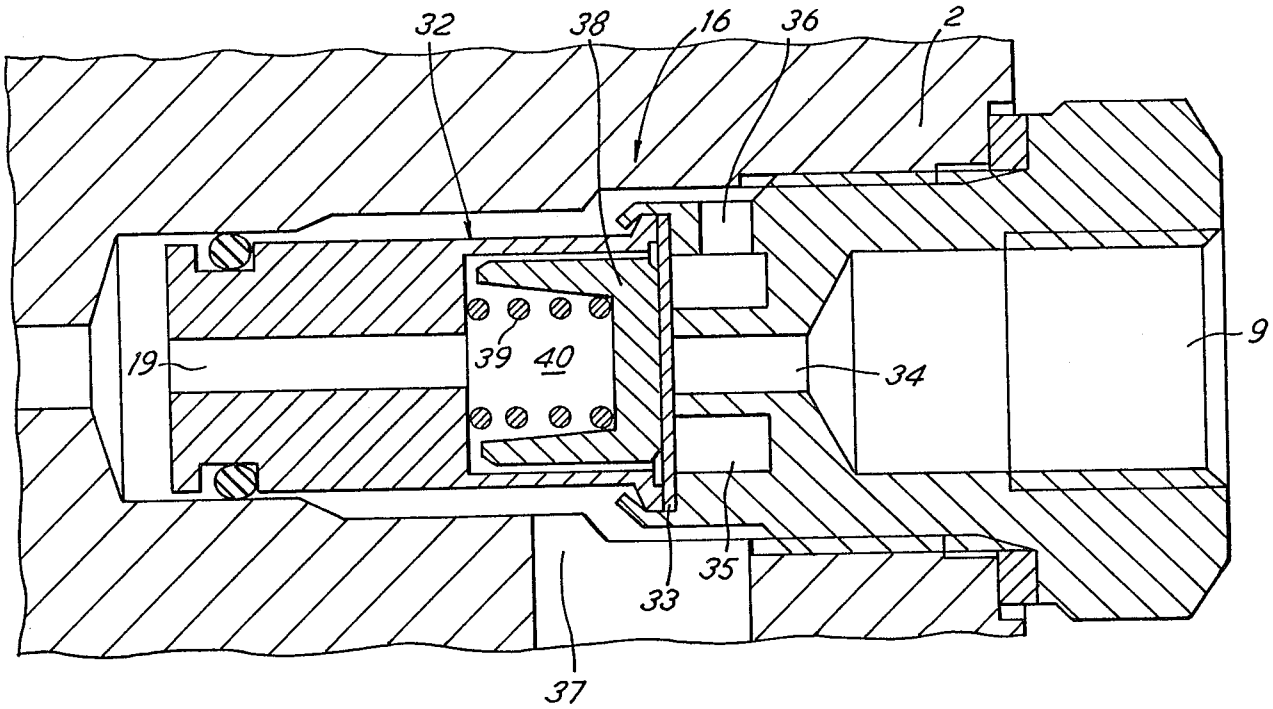
FIG. 5 is a section through one embodiment of a safety valve.

The safety valve 16 is shown in more detail in FIG. 5. It is formed by a multi-part insert 32 which can be screwed into the housing 2. A diaphragm 33 covers a passage 34 leading to the nozzle-connecting nipple 9 as well as an annular groove 35 which communicates with the pressure regulating valve 14 or the cut-off valve 15 by way of a bore 36 and a passage 37. On the opposite side, there is a piston 38 which is influenced by a spring 39. The chamber 40 receiving the spring is connected by way of the oil outlet orifice 19 to the conduit 20 and thus to the suction side 12.

The following operation is obtained. On single line operation, when the plug 27 is screwed into the return nipple 7 (FIG. 4), the connecting passage 23 provides direct communication between the return side 17 and suction side 12. Since the closure member 24 is held open mechanically, no pressure difference need be provided between the return pressure and suction pressure as would be necessary when using a spring-loaded check valve in the connecting passage 23.

When the plug 27 is removed (FIG. 3) so that one can insert the return conduit 8 in the return nipple 7, the connecting passage 23 is automatically closed. Wrong operation is therefore impossible.

During single line as well as double line operation, the pump unit 3 delivers heating oil by way of the pressure regulating valve 14, the cut-off valve 15 and the safety valve 16 to the nozzle 10. Should the pump unit 3 contain air on starting, as is possible during single line operation, this is blown out through the nozzle 10 after opening the cut-off valve 15. In the FIG. 2 embodiment, the check valve 22 ensures that this air will not immediately reach the return side 17 when the cut-off valve 21 is normally open.

The safety valve 16 has a defined opening pressure and a defined closing pressure governed by the spring 39. The suction pressure 12 is also effective in the chamber 40 but this is constant for a given pump construction. The check valve 11 ensures that the pressure height in the case of an upwardly disposed tank has no influence on the behaviour of the safety valve 16.

Many departures may be made from the illustrated constructions without departing from the basic concept of the invention.

For example, the stuffing box of the pump may be connected in the return conduit to provide for lubrication. The pressure regulating valve 14 may have any desired known construction. The same applies to the cut-off valves 15 and 21.

What I claim is:

1. A heating oil pump for selective single line or a double line operation, comprising a housing having a suction nipple, a return nipple adapted for connection to a return line during a double line operation, a closure plug adapted for insertion into the return nipple for closing the return nipple during single line operation, a return conduit opening to the return nipple, a valve seat opening to the return nipple for being in fluid communication through the return nipple to the return conduit even when the plug closes the return nipple, a connecting passage for placing the valve seat in fluid communication with the suction nipple and a closure member resiliently retained in engagement with the valve seat for blocking fluid flow from the return conduit and through the return nipple to the connecting passage when the closure plug is not closing the return nipple and alternately movable to a position by the closure plug closing the return nipple to permit fluid flow from the return conduit and through the nipple and valve seat to the connecting passage, the closure plug having a conical portion that converges in the direction of insertion of the plug into the return nipple and is abuttable against the closure member for moving the closure member to its position to permit fluid flow to the connecting passage.

2. A heating oil pump according to claim 1 in that the closure member has an oblique surface abuttable against the pump conical surface for cooperation therewith to move the closure member when the plug is inserted into the return nipple.

3. A heating oil pump for selective single line or a double line operation, comprising a housing having a nozzle connecting orifice, a suction nipple, a return nipple adapted for connection to a return line during a double line operation, a closure plug adapted for insertion into the return nipple for closing the return nipple during single line operation, a return conduit opening to the return nipple, a valve seat opening at right angles to the return nipple for being in fluid communication through the return nipple to the return conduit even when the plug closes the return nipple, a connecting passage for placing the valve seat in fluid communication with the suction nipple and a closure member resiliently retained in engagement with the valve seat for blocking fluid flow from the return conduit and through the return nipple to the connecting passage when the closure plug is not closing the return nipple and alternately movable to a position by the closure plug closing the return nipple to permit fluid flow from the return conduit and through the nipple and valve seat to the connecting passage, the closure member being moved at a right angle to the direction of the movement of the closure plug as the plug is inserted into the return nipple, the closure member and plug having cooperating, abuttable surfaces to facilitate the moving of the closure member as the plug is inserted into the return nipple, and a pump unit within the housing, the pump unit having a pressure port and a suction port, means for placing the suction port in fluid communication with the connecting passage, a safety valve member having an outlet passage fluidly connected to the nozzle connecting orifice, an annular groove surrounding the outlet passage and fluidly connected to the pressure port, a diaphragm for controlling fluid flow from the annular groove to the outlet passage, a chamber in fluid commincation with the means for placing the suction port in fluid communication with the suction nipple, and spring loaded means in said chamber for resiliently retaining the diaphragm in a position for blocking fluid flow from the annular groove to the outlet passage, and means fluidly connected between the pressure port and the annular groove for controlling fluid flow from the pressure port to the return passage.

4. A heating oil pump for selective single line or a double line operation, comprising a housing having a suction nipple, a return nipple adapted for connection to a return line during a double line operation, a closure plug adapted for insertion into the return nipple for closing the return nipple during single line operation, a return conduit opening to the return nipple, a valve seat opening to the return nipple for being in fluid communication throught the return nipple to the return conduit even when the plug closes the return nipple, a connecting passage for placing the valve seat in fluid communication with the suction nipple and a closure member resiliently retained in engagement with the valve seat for blocking fluid flow from the return conduit and through the return nipple to the connecting passage when the closure plug is not closing the return nipple and alternately movable to a position by the closure plug closing the return nipple to permit fluid flow from the return conduit and through the nipple and valve seat to the connecting passage, and a nozzle connecting orifice, and a pump unit within the housing, the pump unit having a pressure port and a suction port in fluid communication with the connecting passage, a cut-off valve and a spring loaded check valve, the cut-off valve and check valve being fluidly connected in series between the pressure port and the return conduit, the check valve opening toward the return conduit.

5. A heating oil pump for selective single line or a double line operation, comprising a housing having a nozzle connecting orifice, a suction nipple, a return nipple adapted for connection to a return line during a double line operation, a closure plug adapted for insertion into the return nipple for closing the return nipple during single line operation, a return conduit opening to the return nipple, a valve seat opening to the return nipple for being in fluid communication through the return nipple to the return conduit even when the plug closes the return nipple, a connecting passage for placing the valve seat in fluid communication with the suction nipple and a closure member resiliently retained in engagement with the valve seat for blocking fluid flow from the return conduit and through the return nipple to the connecting passage when the closure plug is not closing the return nipple and alternately movable to a position by the closure plug closing the return nipple to permit fluid flow from the return conduit and through the nipple and valve seat to the connecting passage, and a pump unit within the housing, the pump unit having a pressure port and a suction port, means for placing the suction port in fluid communication with the connecting passage, a safety valve member having an outlet passage fluidly connected to the nozzle connecting orifice, an annular groove surrounding the outlet passage and fluidly connected to the pressure port, a diaphragm for controlling fluid flow from the annular groove to the outlet passage, a chamber in fluid communication with the means for placing the suction port in fluid communication with the suction nipple, and spring loaded means in said chamber for resiliently retaining the diaphragm in a position for blocking fluid flow from the annular groove to the outlet passage, and means fluidly connected between the pressure port and the annular groove for controlling fluid flow from the pressure port to the return conduit, and a spring loaded check valve that opens toward the suction port fluidly connected between the connecting passage and the suction nipple.

* * * * *